US012527992B1

(12) United States Patent
Nazer

(10) Patent No.: US 12,527,992 B1
(45) Date of Patent: Jan. 20, 2026

(54) SWIMMING AID TRAINING DEVICE

(71) Applicant: KING SAUD UNIVERSITY, Riyadh (SA)

(72) Inventor: Rakan Ibrahim Nazer, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 153 days.

(21) Appl. No.: 18/949,590

(22) Filed: Nov. 15, 2024

(51) Int. Cl.
*A63B 31/04* (2006.01)

(52) U.S. Cl.
CPC ..... *A63B 31/04* (2013.01)

(58) Field of Classification Search
CPC ..... A63B 31/08; A63B 31/04; A63B 31/02
See application file for complete search history.

(56) References Cited

U.S. PATENT DOCUMENTS

| | | | | | |
|---|---|---|---|---|---|
| 1,548,054 | A | | 8/1925 | Meadows | |
| 2,692,995 | A | | 11/1954 | Le | |
| 3,015,829 | A | | 1/1962 | George | |
| 3,107,371 | A | | 10/1963 | Thompson | |
| 3,286,287 | A | * | 11/1966 | Martin | A63B 31/08 441/59 |
| 3,786,526 | A | * | 1/1974 | Ausseil | A63B 31/08 441/59 |
| 5,707,266 | A | | 1/1998 | Arena | |
| 5,842,896 | A | | 12/1998 | Liveoak | |
| D666,244 | S | * | 8/2012 | Morris | D20/10 |
| 8,790,224 | B1 | | 7/2014 | Davis | |
| 2002/0077010 | A1 | * | 6/2002 | Lukas | A63B 31/08 441/59 |
| 2014/0187110 | A1 | | 7/2014 | Faidi | |
| 2016/0129313 | A1 | * | 5/2016 | Aguiar | A63B 31/12 441/56 |

FOREIGN PATENT DOCUMENTS

| | | | |
|---|---|---|---|
| FR | 2492667 | A1 * | 4/1982 |

* cited by examiner

*Primary Examiner* — Andrew Polay
(74) *Attorney, Agent, or Firm* — Nath, Goldberg & Meyer; Joshua B. Goldberg

(57) ABSTRACT

A swimming aid training device is provided for freestyle swimming. The device is a unitary body including a first ring for a user's wrist and fingers, a second ring for an upper arm or preferably upper forearm of the user and a platform to support a forearm of the user extending between and connecting the first and second rings. A fin extends along a side surface of the unitary body for propelling the user forward during a swimming stroke. The fin has a tapered shape of increasing width from the first ring to the second ring and may include a plurality of fenestrations thereon. The unitary body may be angled between first and second halves and may be formed of flexible plastic with an elastomer formed thereon for support of the forearm.

20 Claims, 3 Drawing Sheets

SWIMMING AID TRAINING DEVICE

BACKGROUND

Field

The disclosure of the present patent application relates to swimming, and particularly to a swimming training device for increasing muscle strength and stroke efficiency.

Description of Related Art

Obtaining the perfect stroke in swimming can be a lifelong challenge. Freestyle swimming is one of the most popular and commonly used swim stroke styles in competitive swimming. Freestyle swimming involves multiple coordinated movements of the arms, neck, shoulders, torso, and legs. During freestyle swimming, having an effective grasp of the water column under each arm with every stroke is essential for generating propulsion and moving forward.

The part of each arm stroke where the arms are extended inside the water and the forearms are moved in a way perpendicular to the body is referred to as the "catch" phase of every stroke. Keeping an early vertical forearm or "high elbow" allows for an effective pull on as much water under the forearms as possible, thus generating efficient forward propulsion.

As with all acquired skills, mastery of freestyle swimming involves drills of breaking down complex movements into easily reproducible steps and gradually bringing the movements synchronously together. Such simple movements or drills focus on one movement or an isolated group of muscles. These drills can be enhanced with the use of swimming aids to simplify swimming or add more water resistance to increase the spatial awareness of the swimmer and strengthen muscle groups.

Hand paddles are effective swimming aids used to create greater water resistance with each catch, thus strengthening the shoulder muscles. Hand paddles main drawback, however, is difficulty in control while swimming due to the high resistance at the weakest part of the catch, since torque is stronger at the elbows than the palms, which can interfere with the development of an effective catch.

Thus, a swimming aid training device solving the aforementioned problems is desired.

SUMMARY

The present disclosure provides a swimming aid training device for increasing muscle strength and stroke efficiency. The device includes a unitary body comprising a first ring configured to position a user's wrist and fingers thereon, and a second ring configured to be positioned on an upper arm or upper forearm of the user. A platform is configured to support a forearm of the user and extends between and connects the first ring and the second ring. A fin extends along a side surface of the unitary body, starting at the first ring, extending alongside the platform, and terminating at the second ring. The fin has a tapered shape of increasing width from the first ring to the second ring.

The first ring may include a thumb loop formed thereon proximate to the side surface of the unitary body on which the fin extends. In addition, the first ring may include a plurality of finger loops formed thereon. The unitary body may be bent at an angle in which a first half contains the first ring and a second half contains the second ring. The angle between the first half and the second half may be about 165 degrees. The fin may include a plurality of fenestrations dispersed thereon of an undulating, oval, or other shape.

The unitary body may be tapered in shape, in which a width of the first ring and a width of the second ring are larger than a width proximate to a midpoint of the unitary body. In addition, the fin may have an undulating shape corresponding to contours of the unitary body. The unitary body may be formed of plastic and may include an elastomer formed on a contact surface for supporting the user's forearm.

The present disclosure further provides a method of using a swimming aid training device. The method includes positioning a wrist and fingers of a user in a first ring of the device, and positioning a second ring of the device on an upper arm or upper forearm of the user. A forearm of the user is positioned on a platform extending between and connecting the first ring and the second ring. A user is propelled during a swimming motion using a fin extending along a side surface of the device, the fin starts at the first ring, extends along a side surface of the platform, and terminates at the second ring. The fin has a tapered shape of increasing width from the first ring to the second ring.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figures 1A, 1B:
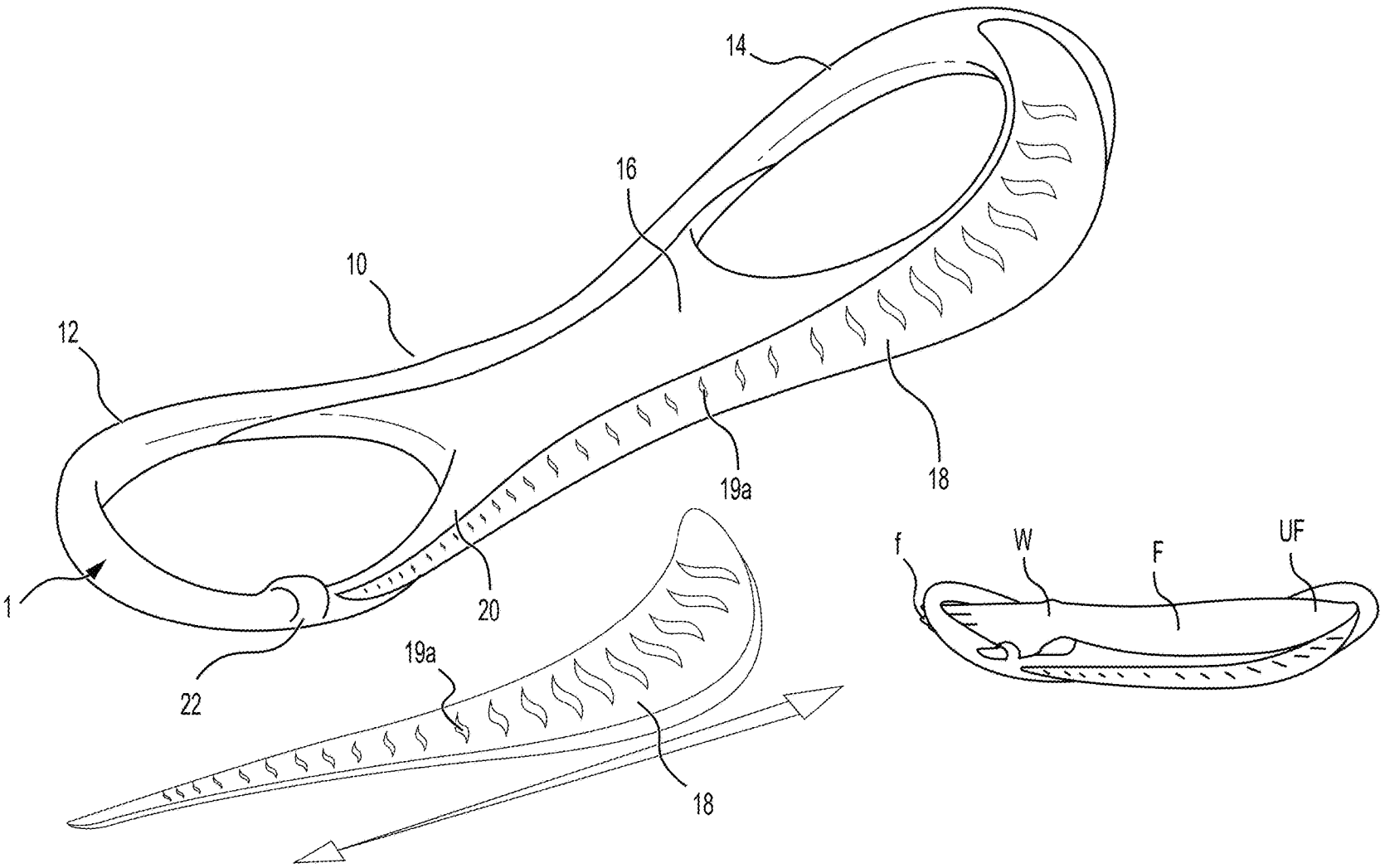
FIG. 1A is a perspective view of a swimming aid training device.
FIG. 1B is a side environmental view of a swimming aid training device.
Figure 1D:
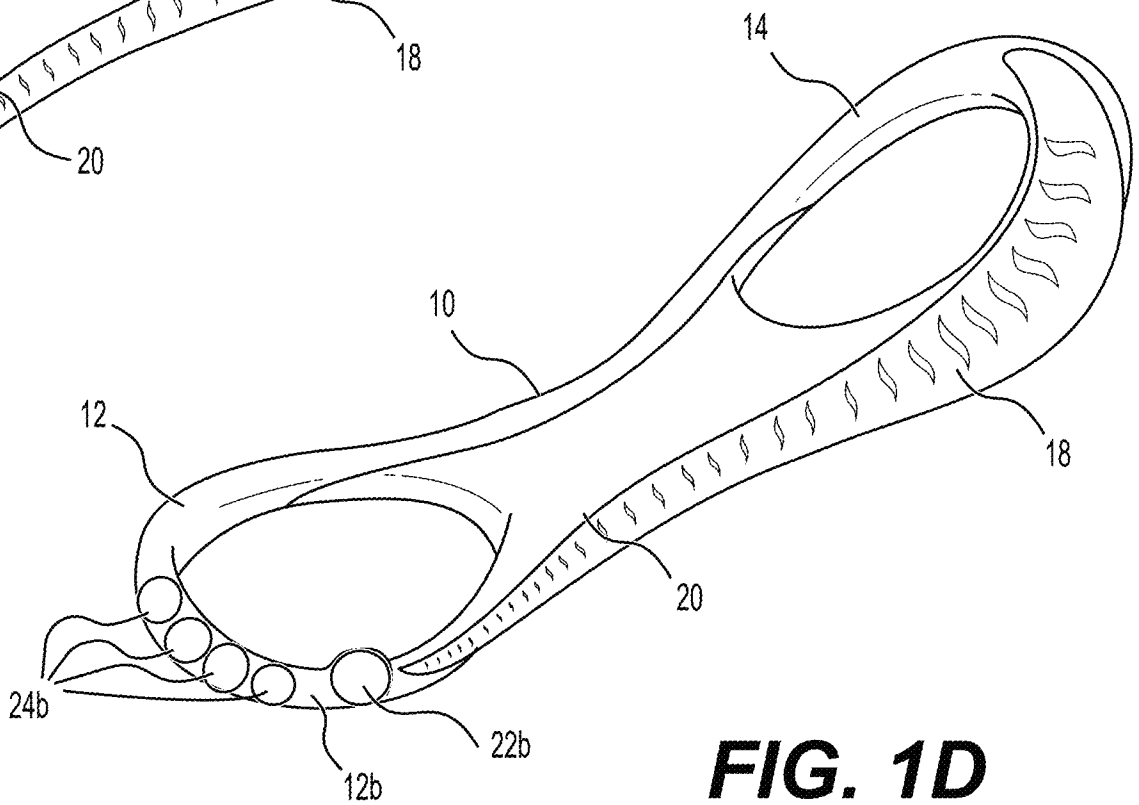
FIG. 1D is a perspective view of a swimming aid training device with finger loops formed in a side surface.
Figure 1C:
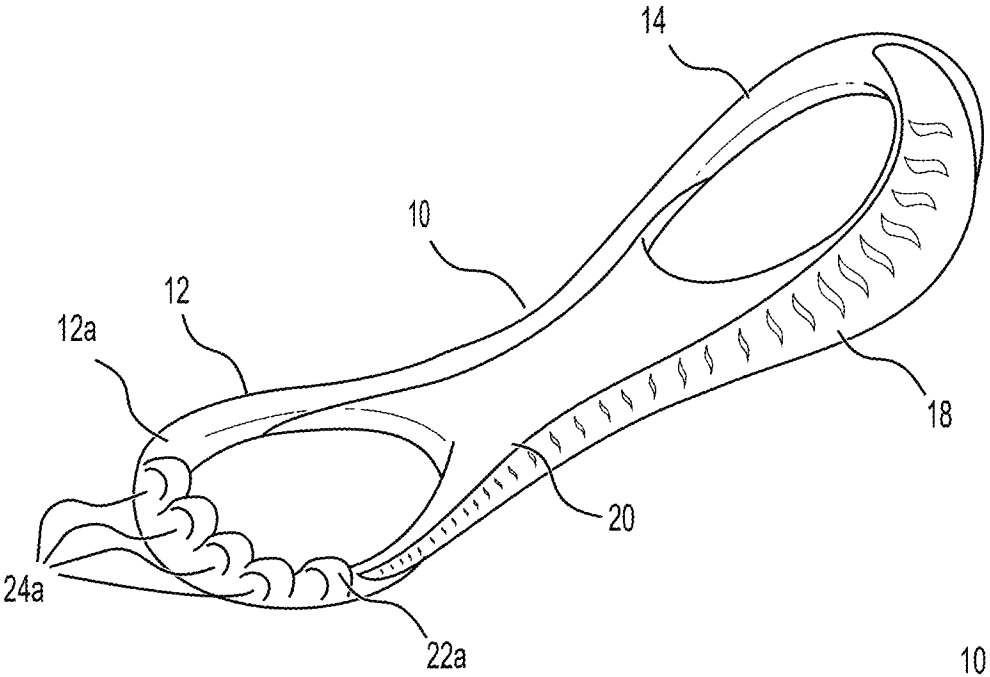
FIG. 1C is a perspective view of a swimming aid training device with finger loops formed on a top surface.

With reference to FIGS. 1A and 1B, the present disclosure provides a swimming aid training device 1. The device 1 includes a unitary body 10 comprising a first ring 12 configured to position a user's wrist W and fingers f, and a second ring 14 configured to be positioned on an upper arm or preferably an upper forearm UF of the user. Although second ring 14 is intended to fit on the upper forearm UF, it is conceivable that small children could still use the device 1 with second ring 14 fitted on the upper arm. A platform 16 is configured to support a forearm F of the user and extends between and connects the first ring 12 and the second ring 14. A fin extends 18 along a side surface 20 of the unitary body 10, starting at the first ring 12, extending alongside the platform 16, and terminating at the second ring 14. The fin may be joined to the unitary body through any suitable means, such as overmolding or mechanical fastening through a snap-fit connection, for example. The fin 18 has a tapered shape of increasing width from the first ring 12 to the second ring 14. The first ring 12 may include a thumb loop 22 formed thereon proximate to the side surface 20 of the unitary body 10 to which the fin is joined. In addition, the first ring 12 may include a plurality of finger loops formed thereon. As shown in FIG. 1C, finger loops 24*a* are formed on a top surface 12*a* of first ring 12. In FIG. 1D, finger loops 24*b* are formed in a side surface 12*b* of first ring 12. Although the example provided shows training device 1 configured for right hand use, it should be understood that a mirror image of the device (not shown) would allow for left hand use.

Figure 2A:
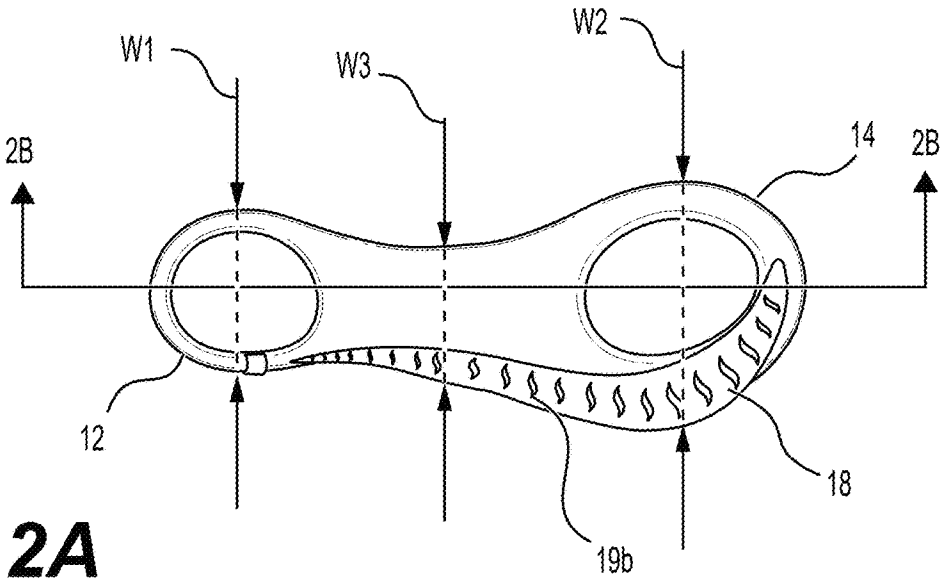
FIG. 2A is a top view of a swimming aid training device.
Figure 2B:
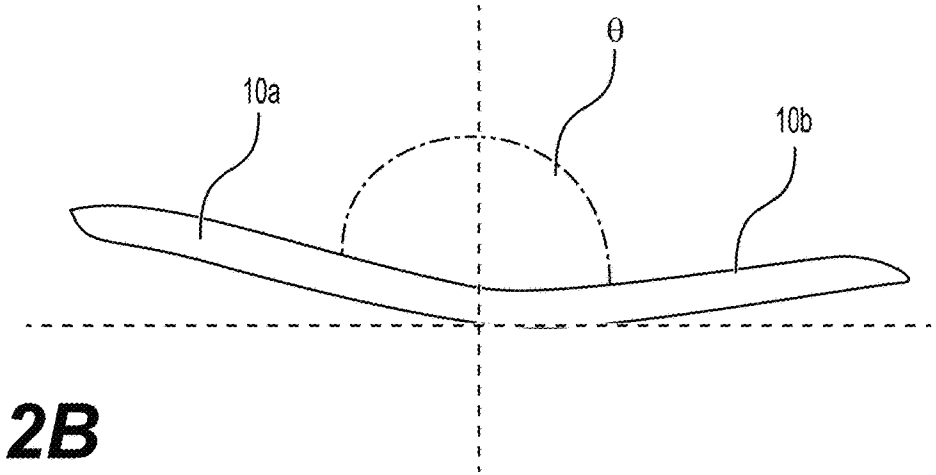
FIG. 2B is a side view of a swimming aid training device.

Turning to FIG. 2A, 2B, the unitary body 10 may be bent at an angle θ in which a first half 10*a* contains the first ring 12 and a second half 10*b* contains the second ring 14. The angle θ between the first half and the second half may be about 165 degrees. The term "about" as used herein represents a ±10% variation from the stated value. The fin 18 may include a plurality of fenestrations dispersed thereon of an undulating 19*a* (FIG. 1), oval 19*b* (FIG. 2A), or other shape. The inclusion of fenestrations allows water to flow through fin 18, to reduce overall resistance and turbulence which may impede the movement of the forearm during a catch phase of a freestyle swimming stroke.

The unitary body 10 may be tapered in shape, in which a width W1 of the first ring 12 and width W2 of the second ring 14 is larger than a width W3 proximate to a midpoint of the unitary body 10. In a non-limiting example, the width W1 may be about 6-12 cm, the width W2 may be about 8-16 cm, the width W3 may be about 4-8 cm. The ratio of W1:W2:W3 may be about 3:4:2 respectively.

The fin 18 may have an overall undulating shape corresponding to contours of the unitary body, which is a convex shape at first ring 12, concave shape at platform 16 and convex shape at second ring 14. The unitary body 10 may be formed of flexible plastic and may include an elastomer such as silicone or rubber formed on a contact surface of platform 16, such as through over molding or other suitable means, for supporting forearm F of the user (FIG. 1B).

Referring to FIGS. 1A-2B, the present disclosure further provides a method of using a swimming aid training device 1. The method includes positioning a wrist W and fingers f of a user in a first ring 12 of the device 1, and positioning a second ring 14 of the device 1 on an upper arm or upper forearm UF of the user. A forearm F of the user is positioned on a platform 16 extending between and connecting the first ring 12 and the second ring 14. A user is propelled during a swimming motion using a fin 18 extending along a side surface 20 of the device 1. The fin starts at the first ring 12, extends along a side surface 20 of the platform 16, and terminates at the second ring 14. The fin 18 has a tapered shape of increasing width from the first ring 12 to the second ring 14.

It is to be understood that the swimming aid training device is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A swimming aid training device, comprising:
a unitary body comprising a first ring configured to position a user's wrist and fingers thereon, a second ring configured to be positioned on an upper forearm of the user, and a platform extending between and connecting the first ring and the second ring, wherein the platform is configured to support a forearm of the user; and
a fin extending along a side surface of the unitary body, the fin starting at the first ring, extending alongside the platform, and terminating at the second ring, wherein the fin has a tapered shape with increasing width from the first ring to the second ring.

2. The swimming aid training device of claim 1, wherein the first ring includes a thumb loop formed thereon proximate to the side surface of the unitary body.

3. The swimming aid training device of claim 1, wherein the first ring includes a plurality of finger loops formed thereon.

4. The swimming aid training device of claim 1, wherein the unitary body includes a first half containing the first ring and a second half containing the second ring, the first half and second half oriented at an angle to each other.

5. The swimming aid training device of claim 4, wherein the first half and second half are oriented at an angle of about 165 degrees.

6. The swimming aid training device of claim 1, wherein the fin includes a plurality of fenestrations dispersed thereon.

7. The swimming aid training device of claim 6, wherein the fenestrations include an undulating shape.

8. The swimming aid training device of claim 6, wherein the fenestrations include an oval shape.

9. The swimming aid training device of claim 1, wherein the unitary body is tapered in shape, in which a width of the first ring and a width of the second ring is larger than a width proximate to a midpoint of the unitary body.

10. The swimming aid training device of claim 9, wherein the fin comprises an undulating shape corresponding to contours of the unitary body.

11. The swimming aid training device as recited in claim 1, wherein the unitary body is formed of plastic.

12. The swimming aid training device as recited in claim 1, wherein the platform includes an elastomer formed on a contact surface for supporting the user's forearm.

13. A method of using a swimming aid training device, the method comprising:
positioning a wrist and fingers of a user in a first ring of the device;
positioning a second ring of the device on an upper arm or upper forearm of the user;
positioning a forearm of the user on a platform extending between and connecting the first ring and the second ring; and
propelling the user during a swimming motion using a fin extending along a side surface of the device, the fin starting at the first ring, extending along a side surface of the platform, and terminating at the second ring, wherein the fin has a tapered shape of increasing width from the first ring to the second ring.

14. A swimming aid training device, comprising:
a unitary body including a first ring configured to receive a wrist and fingers of a swimmer, the first ring including a thumbhole formed in a rim thereof proximate a side surface of the unitary body, a second ring configured to receive an upper arm or upper forearm of the swimmer, and a platform for supporting a forearm of the swimmer, the platform extending between and connecting the first ring and the second ring, wherein the unitary body is tapered in shape and has a width proximate a midpoint thereof which is narrower than a width at the first ring and second ring; and
a fin extending along a side surface of the tapered body, wherein the fin is tapered and has increasing width from the first ring to the second ring.

15. The swimming aid training device as recited in claim 14, wherein the unitary body is formed of plastic.

16. The swimming aid training device as recited in claim 15, wherein the platform comprises an elastomer on a contact surface thereof for the forearm of the swimmer.

17. The swimming aid training device as recited in claim 14, wherein the fin comprises a plurality of fenestrations thereon.

18. The swimming aid training device of claim 14, wherein the unitary body includes a first half containing the first ring, and a second half containing the second ring, wherein the first half and second half are oriented at an angle from each other.

19. The swimming aid training device of claim 18, wherein the first half and second half are oriented at an angle of about 165 degrees.

20. The swimming aid training device of claim 14, wherein the fin comprises an undulating shape corresponding to contours of the unitary body.

* * * * *